US012188352B2

(12) United States Patent
Glaser

(10) Patent No.: US 12,188,352 B2
(45) Date of Patent: Jan. 7, 2025

(54) LATERAL ACCESS CONTROL IN DOWNHOLE WINDOW JOINTS

(71) Applicant: Halliburton Energy Services, Inc., Houston, TX (US)

(72) Inventor: Mark Christopher Glaser, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/304,503

(22) Filed: Apr. 21, 2023

(65) Prior Publication Data

US 2024/0352801 A1 Oct. 24, 2024

(51) Int. Cl.
*E21B 7/06* (2006.01)

(52) U.S. Cl.
CPC ..... *E21B 7/061* (2013.01)

(58) Field of Classification Search
CPC ..... E21B 29/06; E21B 7/061
See application file for complete search history.

(56) References Cited

U.S. PATENT DOCUMENTS

| | | | |
|---|---|---|---|
| 4,007,797 | A | 2/1977 | Jeter |
| 4,497,381 | A | 2/1985 | Dickinson, III et al. |
| 4,852,666 | A | 8/1989 | Brunet et al. |
| 6,253,843 | B1 | 7/2001 | Rawson et al. |
| 8,210,254 | B2 | 7/2012 | Zweifel et al. |
| 8,230,920 | B2 | 7/2012 | Bell |
| 8,459,345 | B2 | 6/2013 | Bell |
| 8,789,590 | B2 | 7/2014 | Donovan |
| 8,967,243 | B2 | 3/2015 | Reaux |
| 9,010,422 | B2 | 4/2015 | Donovan |
| 10,563,483 | B2 | 2/2020 | Steele |

(Continued)

FOREIGN PATENT DOCUMENTS

| | | | |
|---|---|---|---|
| CN | 111927364 | B | 5/2022 |
| CN | 217735432 | U | 11/2022 |
| WO | 2022081020 | A1 | 4/2022 |

OTHER PUBLICATIONS

Core Design Ltd., "Multilateral Window Level 2", https://coredesignltd.com/portfolio-3-columns/other-tools/multilateral-windows-level-2/, 1 pg, Leduc, AB Canada.

(Continued)

*Primary Examiner* — Robert E Fuller
*Assistant Examiner* — Lamia Quaim
(74) *Attorney, Agent, or Firm* — K&L Gates LLP

(57) ABSTRACT

Lateral access control in downhole window joint is provided via a window joint. The window joint includes an interior cavity with a first end and a second end opposite to the first end, a first opening defined at the first end, and a lateral opening through a wall of the window joint and into the interior cavity between the first end and the second end. The window joint also includes a deflector where, in a first state, the deflector permits access between the first end and the second end and, in a second state, the deflector blocks access between the first end and the second end and permits access between the first end and the lateral opening by deflecting an object travelling through the lateral opening. The window joint also includes an access control system configured to transition the deflector between the first state and the second state.

18 Claims, 9 Drawing Sheets

(56) References Cited

U.S. PATENT DOCUMENTS

| | | | | |
|---|---|---|---|---|
| 2011/0259609 | A1 | 10/2011 | Hessels et al. | |
| 2017/0350203 | A1 | 12/2017 | Rud | |
| 2019/0120021 | A1* | 4/2019 | Steele | E21B 23/12 |
| 2020/0149370 | A1 | 5/2020 | Stark et al. | |

OTHER PUBLICATIONS

International Search Report and Written Opinion dated Jan. 18, 2024 for corresponding PCT Patent Application No. PCT/US2023/019419 filed on Apr. 21, 2023.

* cited by examiner

LATERAL ACCESS CONTROL IN DOWNHOLE WINDOW JOINTS

BACKGROUND

When drilling wells, various bore pathways may be formed, with an initial or main pathway being defined from a bore hold at the surface (e.g., vertically or at another angle) and one or more pathways may be defined laterally from the initial pathway. These lateral pathways may be smaller in diameter or length than as the initial or main pathway, and may project at any angle away from the initial or main pathway. Accordingly, equipment or instrumentation that is to be placed into a lateral pathway is initially inserted through the main pathway, and is re-directed from the initial/main pathway into the lateral pathway, which can be a challenging or time-consuming operation to perform.

BRIEF DESCRIPTION OF THE DRAWINGS

Embodiments of lateral access control in downhole window joints are described with reference to the following FIGs. The same or sequentially similar numbers are used throughout the FIGs. to reference like features and components. The features depicted in the FIGs. are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes systems and methods for providing lateral access control in downhole window joints. The lateral access systems, and methods of use thereof, described herein provide for greater ease of use of downhole window joints with selective access to one or more lateral pathways defined from a main pathway, which increases the speed at which equipment can be placed downhole, reduces wear and tear of downhole elements (e.g., by reducing the number of trips for equipment to make through the window joints), and provides for greater control from the surface, among other benefits.

Figure 1:
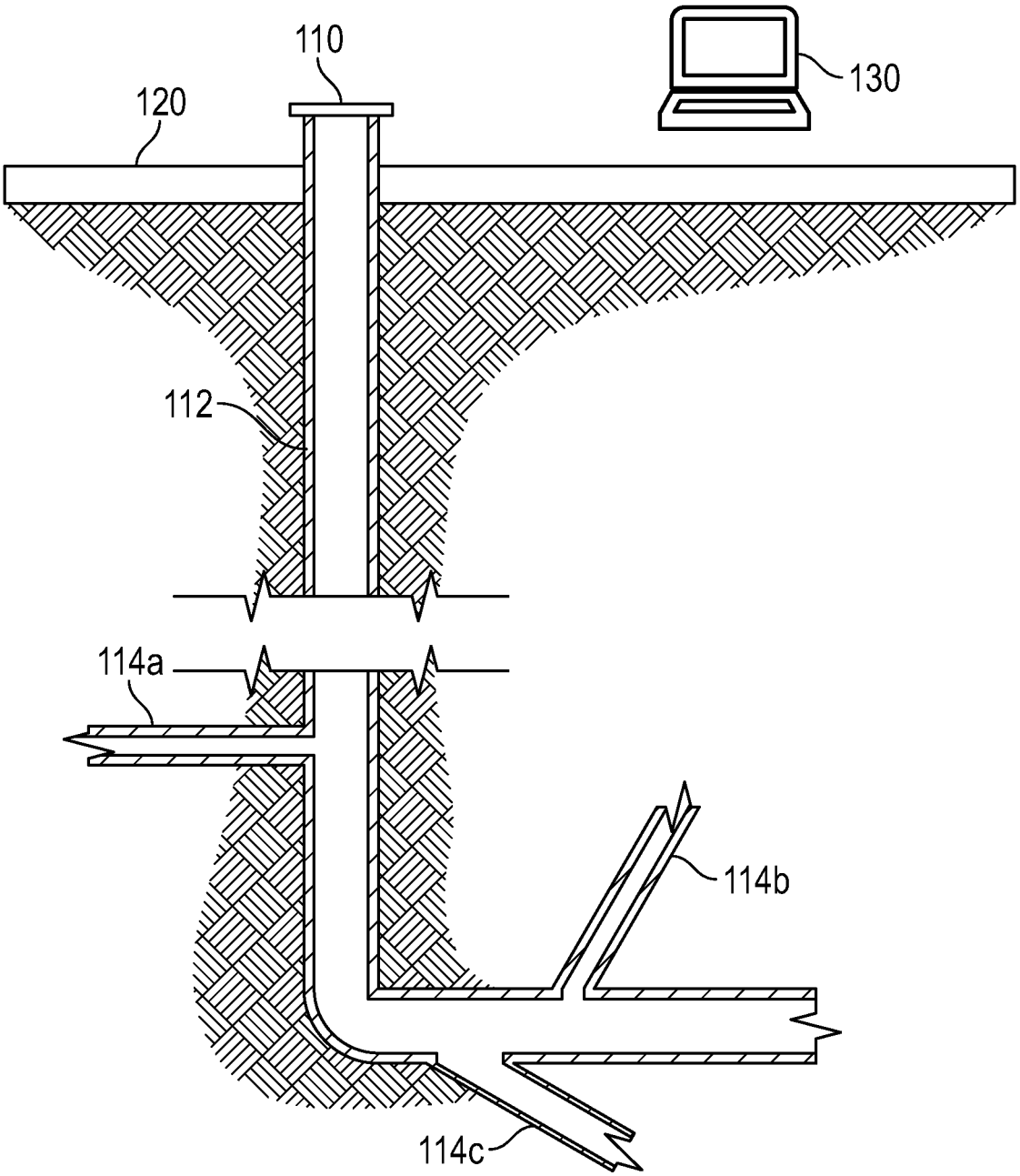
FIG. 1 is a cross-sectional diagram showing a bore and associated control; equipment, according to embodiments of the present disclosure.

Turning now the FIGs., FIG. 1 is a cross-sectional diagram of a bore 110 and access equipment for the bore 110, according to embodiments of the present disclosure. As illustrated, the bore 110 is formed at a surface 120 and extends into a substrate to a depth along a main pathway 112, and may include one or more branches or lateral pathways 114*a-c* (generally or collectively, lateral pathway 114). Each of the lateral pathways 114 branch off from the main pathway 112 at various angles to provide access to portions of the substrate not accessed by the main pathway 112 (e.g., for fluid injection, exploration, placement of sensors or other equipment, etc.). The main pathway 112 may change in course or angle at different points, allowing some of the lateral pathways 114 to branch off of the main pathway 112 at different angles, but be parallel to one another or different portions of the main pathway 112. The present disclosure contemplates that more or fewer lateral pathways 114 may branch from a main pathway 112 at various different angles and with various different inner diameters than the non-limiting examples shown in FIG. 1.

A controller 130 located at the surface 120 may be connected to various objects inserted into the wellbore (e.g., wireline, liners, downhole tools, instruments, sensors, etc.) via electrical wires, pneumatic lines, hydraulic lines, or combinations thereof to receive feedback from downhole equipment and send control signals to the downhole equipment. In various embodiments, the controller may include one or more computing devices (such as computing device 900 described in greater detail in relation to FIG. 9). In various embodiments, the controller 130 may additionally or alternatively to a computing device, include an electrical switch (e.g., to apply or remove an electrical signal) connected to a power supply or a pump (e.g., to apply a hydraulic of pneumatic signal) connected to a hydraulic of pneumatic fluid supply.

As used herein, the term "downhole", and variations thereof, refers to a position that is further from the opening of the bore 110 along a selected path than a position referred to as "uphole", regardless of the absolute depth within the substrate of an element so-described. For example, when describing a main pathway 112 that descends to a depth of X meters (m) and curves back upward to travel Y meters to end at a depth of X-Y m (e.g., in a "J" shape), a first element located at the end of the main pathway 112 is Y meters downhole from a second element located at the inflection point at X m of depth despite being located at a shallower absolute depth than the second element. Similarly, the second element may be referred to as "uphole" relative to the first element despite being located at a deeper absolute depth than the first element.

Figure 2:
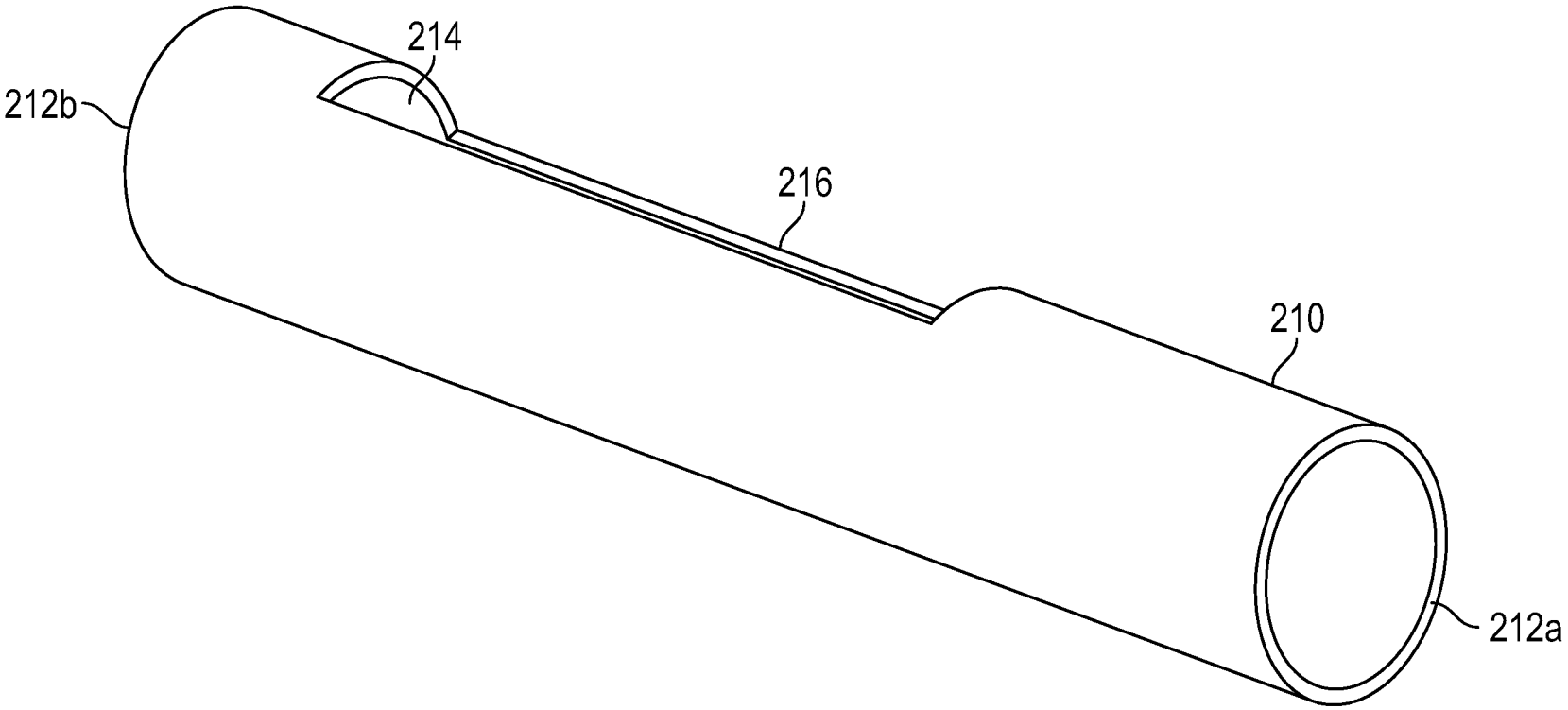
FIG. 2 is an isometric view showing a window joint, as may be inserted in a main pathway of a bore, according to embodiments of the present disclosure.

FIG. 2 is an isometric view of a window joint 210, as may be inserted in a main pathway of a bore, according to embodiments of the present disclosure. The window joint 210 is locatable in the wellbore and may be made of one or more segments that are joined together (either at the surface or within the bore) and run through some or all of the main pathway. The window joint 210 has an interior cavity defined by a wall 216 with a first end and a second end opposite to the first end. In various embodiments, the wall 216 provides attachment points for various instruments, equipment, piping, other downhole tools, and wiring for accessing or communicating with the instruments and equipment placed downhole.

In some embodiments, the window joint 210 is included in a liner inserted into wellbore provides support within the pathways (e.g., to reduce a likelihood of collapse), attachment points for various sensors or other equipment, and guidance for the insertion of additional equipment into the borehole. In some embodiments, the window joint 210 is included in a downhole tool, which may be inserted into the wellbore to deliver additional tooling downhole. The window joint 210 may include one or more main openings 212*a-b* (generally or collectively, main openings 212) to be open on both ends or be open only at the surface (e.g., closed at a downhole end).

In various embodiments, to access the various lateral pathways from the main pathway, the window joint 210 includes a lateral openings 214 that permits access through the wall 216 of the window joint 210 to the various lateral openings. The present disclosure contemplates that more or fewer lateral openings 214 may be formed in an assembly including multiple window joints 210 (which may include the same number or more lateral openings 214 than there are lateral pathways) than the non-limiting example shown in FIG. 2. Additionally, although generally described in relation to a window joint 210 placed into the main pathway, the present disclosure contemplates that supplemental window joints may be placed into the lateral pathways (e.g., for the same purposes as the window joint 210 is placed in the main pathway) and that the lateral pathways may branch into further-lateral pathways.

As discussed in greater detail in regard to FIGS. 3A-7B, the window joint 210 integrated various deflectors and associated access control systems, which are in communication with a controller on the surface. The controller on the surface sends various control signals to the access control systems to set the state of a deflector to guide objects inserted downhole to various destinations at junctions between the main and lateral pathways in the borehole. By integrating the deflector and the access control system into the wall 216 of the window joint 210, an operator can forego insertion operations to place or remove a deflector at a specified junction, thereby saving time in accessing different parts of the wellbore.

Because axial space in the wall 216 of the window joint 210 is at a premium (affecting structural integrity or the volume of the internal cavity of the window joint 210), and inadvertent projection into the internal cavity may affect the ability to travel through the main pathway, the lateral access systems are generally integrated into cavities formed in the walls 216 of the window joint 210 and are generally configured to travel (or affect travel) longitudinally to the window joint 210 (rather than axially) to change the state of the respective deflector.

Figure 3A:
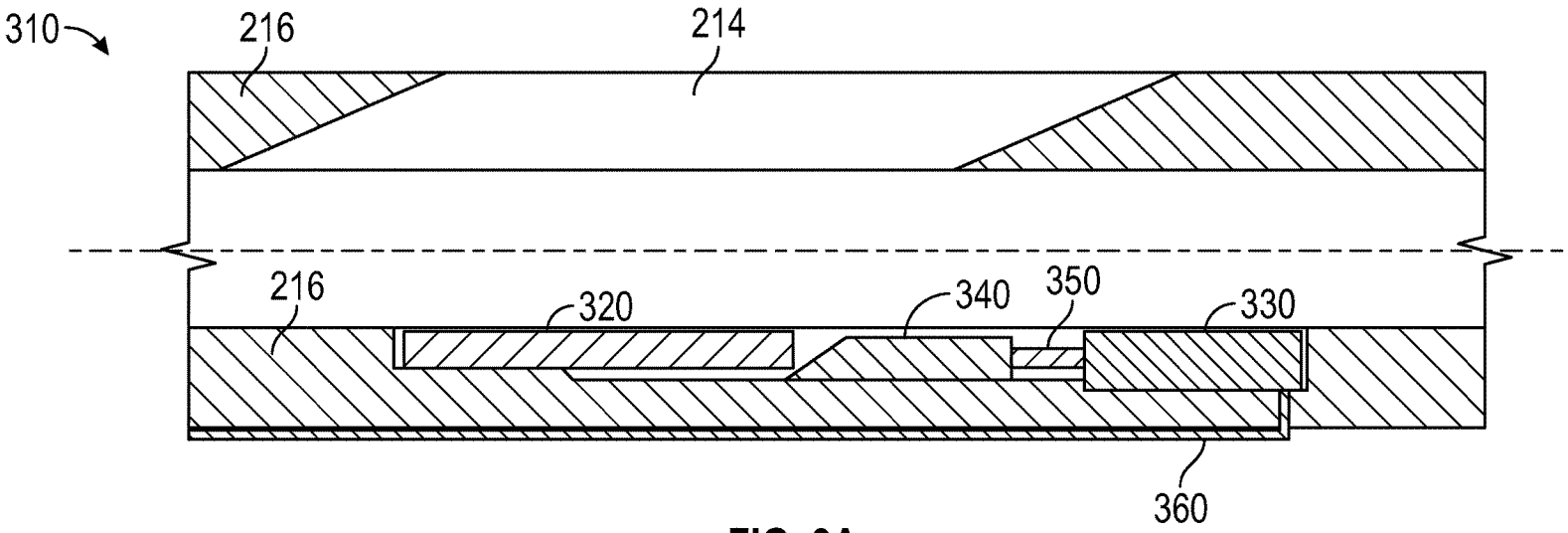
FIGS. 3A-3B are cross-sectional diagrams showing a lateral access system including a piston-actuated ramp in a first state and a second state, respectively, according to embodiments of the present disclosure.
Figure 3B:
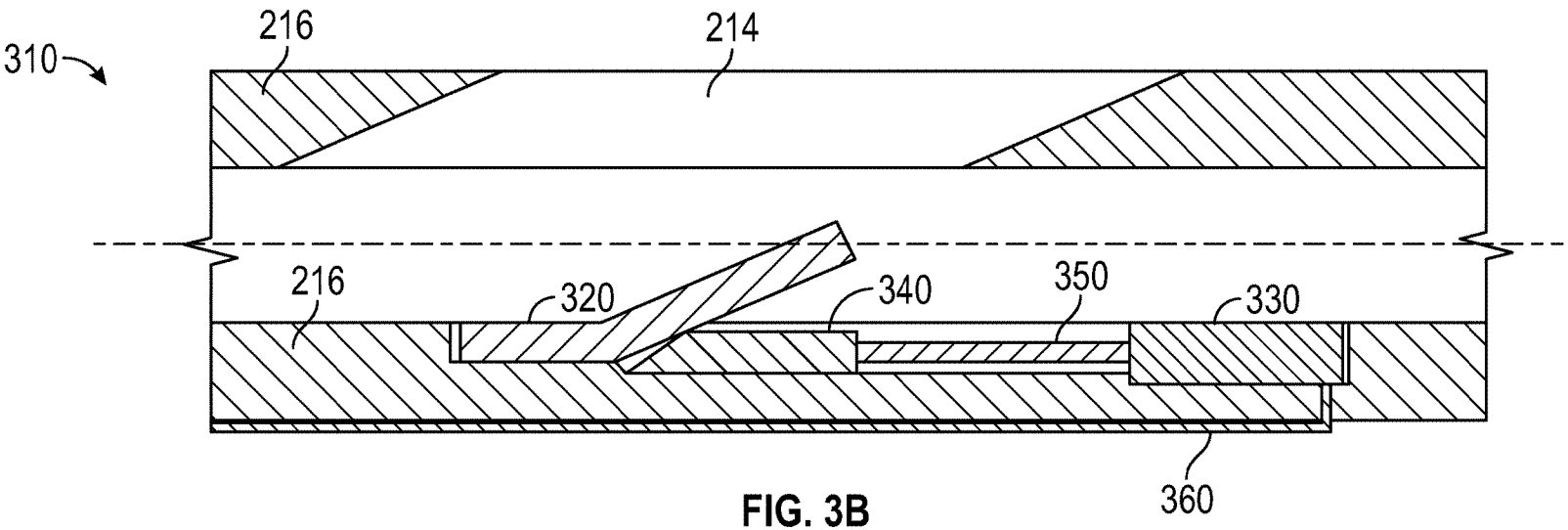

FIGS. 3A-3B are cross-sectional diagrams showing a lateral access system 310 including a piston-actuated deflector 320 in a first state and a second state, respectively, according to embodiments of the present disclosure. The walls 216 of the window joint 210 incorporate a lateral access system 310, which is selectively controllable from a controller located at the surface. The lateral access system 310 may include one or more computing devices (such as the computing device 900 described in greater detail in relation to FIG. 9) to process electrical signals received from the controller. In some embodiments, in addition to or alternatively to processing electrical signals, the lateral access system 310 can use applied pressures from hydraulic or pneumatic fluids as control signals to extend or retract the ramp 340.

When in the first state, as is shown in FIG. 3A, the deflector 320 permits access between the first end and the second end of the window joint along the main pathway; whereas in the second state, as is shown in FIG. 3B, the deflector 320 blocks access between the first end and the second end of the window joint, and permits access between the first end of the window joint and the lateral opening 214, to thereby direct any equipment traveling downhole (e.g., from left to right in the illustrated view) in the main pathway to enter the lateral pathway. Similarly, in the second state, the deflector 320 helps guide any equipment traveling uphole in the lateral pathway to reenter the main pathway.

As shown in FIGS. 3A and 3B, one embodiment of the lateral access system 310 includes a deflector 320 of a bow spring or cantilever spring, which is transitioned between the first state and the second state via the positioning of a ramp 340 that pushes (e.g., via a wedge shape) the deflector 320 upward, into the main pathway, or retracts to allow the spring to relax and move out of the main pathway. The spring of the deflector 320 is connected on a connected end to the interior cavity of the window joint and has a free end (opposite to the connected end) is positioned downhole in the window joint, such that in a first state the spring is relaxed, and in the second state the spring is placed under tension.

In various embodiments, the ramp 340 is moved between a first position (that allows the spring to relax) and a second position (that pushes the deflector 320 upward) via a piston 350 controlled via a solenoid 330. The solenoid 330 may receive various control signals via a control line 360 connected to the above-bore controller, which communicates whether to extend, retract, or maintain a position of the ramp 340 via an electrical signal (e.g., via an electrical motor) or an applied pressure via a hydraulic fluid or pneumatic fluid carried in the control line 360.

Although the deflector 320 is illustrated as having a substantially rectangular cross-section, the present disclosure contemplates that various other cross-sectional areas may be used with a deflector 320. For example, the deflector 320 may include one or more areas of reduced thickness that encourage the spring to deflect at an area of reduced thickness when the ramp 340 extends. In some embodiments, the deflector 320 may include a tapered or beveled edge (e.g., rather than a sharp corner) on the downhole end to reduce the likelihood that equipment traveling uphole catches on or otherwise inadvertently engages with the deflector 320.

Figure 4A:
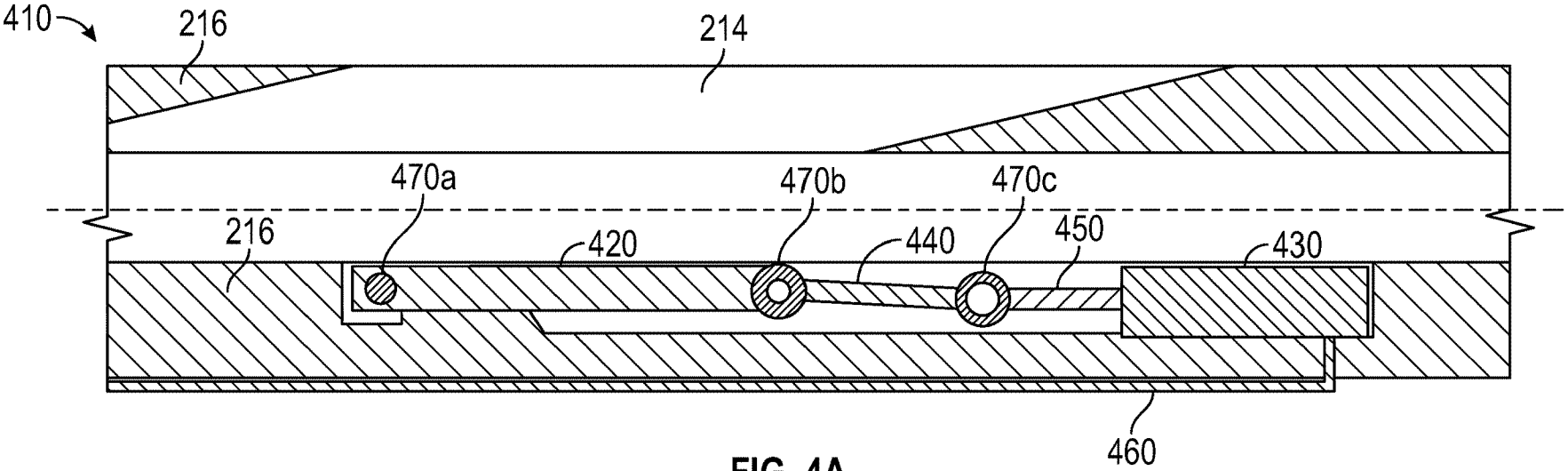
FIGS. 4A-4B are cross-sectional diagrams showing a lateral access system that includes a bar linkage in a first state and a second state, respectively, according to embodiments of the present disclosure.
Figure 4B:
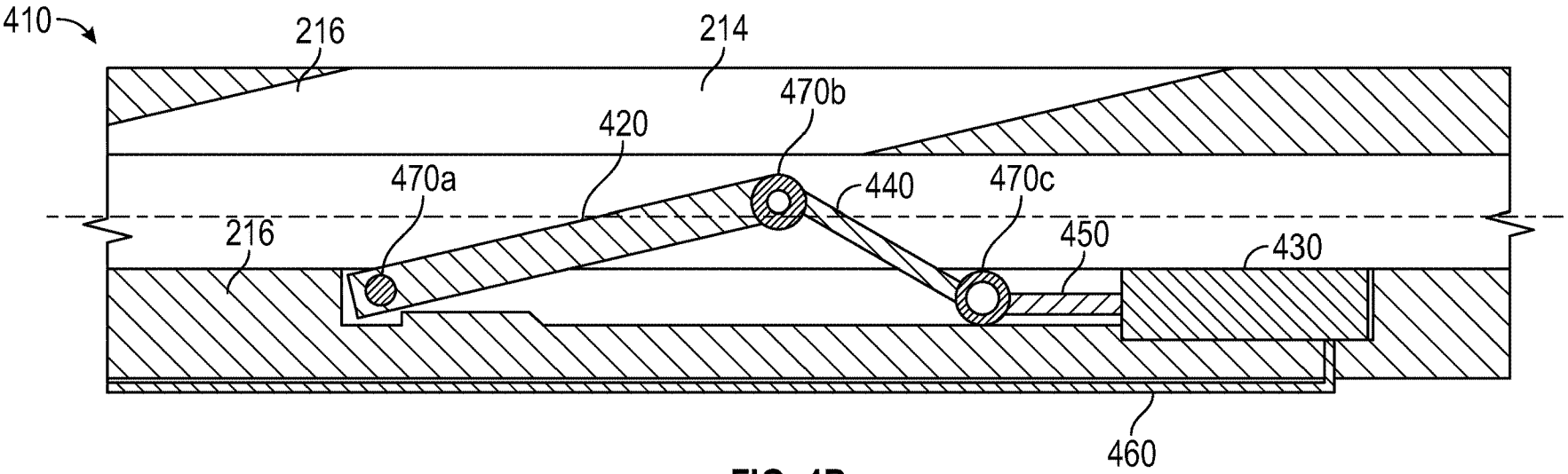

FIGS. 4A-4B are cross-sectional diagrams showing a lateral access system that includes a bar linkage-actuated deflector (e.g., a four bar linkage) in a first state and a second state, respectively, according to embodiments of the present disclosure. The walls 216 of the window joint 210 incorporate a lateral access system 410, which is selectively controllable from a controller located at the surface. The lateral access system 410 may include one or more computing devices (such as the computing device 900 described in greater detail in relation to FIG. 9) to process electrical signals received from the controller. In some embodiments, in addition to or alternatively to processing electrical signals, the lateral access system 410 can use applied pressures from hydraulic or pneumatic fluids as control signals.

When in the first state, as is shown in FIG. 4A, the deflector 420 permits access between the first end and the second end of the window joint along the main pathway; whereas in the second state, as is shown in FIG. 4B, the deflector 420 blocks access between the first end and the second end of the window joint, and permits access between the first end of the window joint and the lateral opening 214, to thereby direct any equipment traveling downhole (e.g., from left to right in the illustrated view) in the main pathway to enter the lateral pathway. Similarly, in the second state, the deflector 420 helps guide any equipment traveling uphole in the lateral pathway to reenter the main pathway.

As shown in FIGS. 4A and 4B, one embodiment of the lateral access system 410 includes a deflector 420 that is rotatably mounted to the window joint via a first pivot pin 470*a* (generally or collectively, pivot pin 470), which is transitioned between the first state and the second state via a linkage 440 that pushes the deflector 420 upward, into the main pathway, or pulls the deflector 420 downward, out of the main pathway. In various embodiments, the linkage 440 is moved between a first position and a second position via a piston 450 controlled via a solenoid 430. The linkage 440 is rotatably connected on a first end to the downhole end of the deflector by a second pivot pin 470*b* and to an uphole end of the piston 450 via a third pivot pin 470*c*. The solenoid 430 may receive various control signals via a control line 460 connected to the above-bore controller, which communicates whether to extend, retract, or maintain a position of the piston 450 via an electrical signal or an applied pressure via a hydraulic fluid or pneumatic fluid carried in the control line 460 to extend or retract the piston 450.

Although the deflector 420 is illustrated as having a substantially rectangular cross-section, the present disclosure contemplates that various other cross-sectional areas may be used with a deflector 420. In some embodiments, the deflector 420 may include a tapered or beveled edge (e.g., rather than a sharp corner) on the downhole end to reduce the likelihood that equipment traveling uphole catches on or otherwise inadvertently engages with the deflector 420.

In various embodiments, the deflector 420 may be biased to either the first state, shown in FIG. 4A, or the second state, shown in FIG. 4B, and the applied control signal is applied to transition the deflector 420 to the non-biased state and removed to allow the deflector 420 to return to the biased state. In some embodiments, the deflector 420 remains in one of the first state or the second state when transitioned thereto by a control signal until a second control signal is applied to transition the deflector 420 to the other state.

Figure 5A:
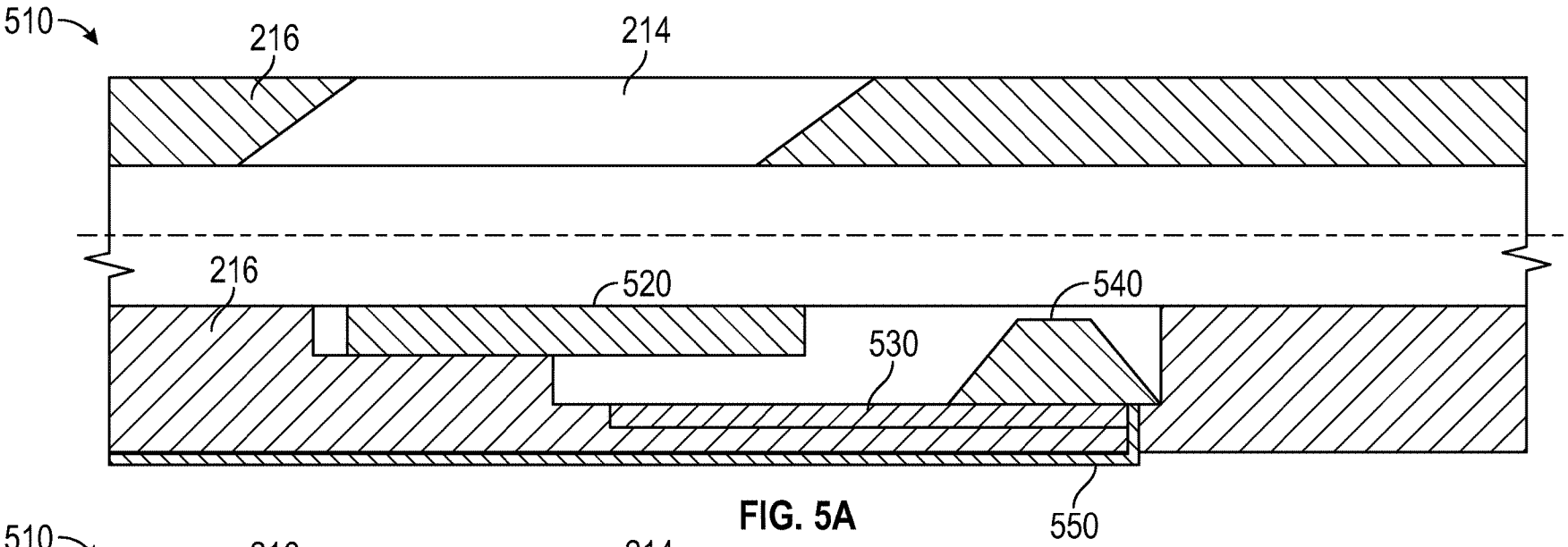
FIGS. 5A-5B are cross-sectional diagrams showing a lateral access system that includes an electromagnetic track in a first state and a second state, respectively, according to embodiments of the present disclosure.
Figure 5B:
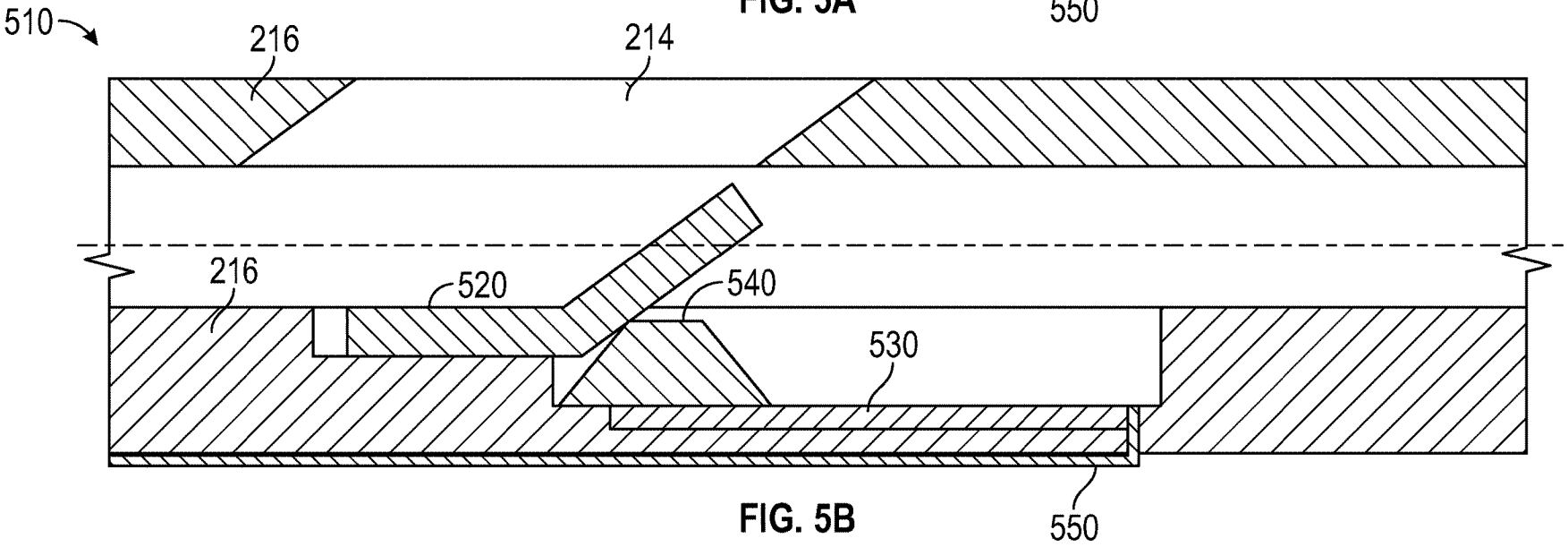

FIGS. 5A-5B are cross-sectional diagrams showing a lateral access system that includes an electromagnetic track actuated deflector in a first state and a second state, respectively, according to embodiments of the present disclosure. The walls 216 of the window joint 210 incorporate a lateral access system 510, which is selectively controllable from a controller located at the surface. The lateral access system 510 may include one or more computing devices (such as the computing device 900 described in greater detail in relation to FIG. 9) to process electrical signals received from the controller. In some embodiments, in addition to or alternatively to processing electrical signals, the lateral access system 510 can use applied pressures from hydraulic or pneumatic fluids as control signals to position the ramp 540.

When in the first state, as is shown in FIG. 5A, the deflector 520 permits access between the first end and the second end of the window joint along the main pathway; whereas in the second state, as is shown in FIG. 5B, the deflector 520 blocks access between the first end and the second end of the window joint, and permits access between the first end of the window joint and the lateral opening 214, to thereby direct any equipment traveling downhole (e.g., from left to right in the illustrated view) in the main pathway to enter the lateral pathway. Similarly, in the second state, the deflector 520 helps guide any equipment traveling uphole in the lateral pathway to reenter the main pathway.

As shown in FIGS. 5A and 5B, one embodiment of the lateral access system 510 includes a deflector 520 of a bow spring or cantilever spring, which is transitioned between the first state and the second state via the positioning of a ramp 540 that pushes (e.g., via a wedge shape) the deflector 520 upward, into the main pathway, or retracts to allow the spring to relax and move out of the main pathway. The spring of the deflector 520 is connected on a connected end to the interior cavity of the window joint and has a free end (opposite to the connected end) is positioned downhole in the window joint, such that in a first state the spring is relaxed, and in the second state the spring is placed under tension.

In various embodiments, the ramp 540 is driven between a first position (that allows the spring to relax) and a second position (that pushes the deflector 520 upward) via an applied electrical signal that energizes some of all of the track 530. In various embodiments, the track 530 includes a series of electromagnets when the above-bore controller uses electrical signals to control where to position the ramp 540 along the track 530.

Although the deflector 520 is illustrated as having a substantially rectangular cross-section, the present disclosure contemplates that various other cross-sectional areas may be used with a deflector 520. For example, the deflector 520 may include one or more areas of reduced thickness that encourage the spring to deflect at an area of reduced thickness when the ramp 540 extends. In some embodiments, the deflector 520 may include a tapered or beveled edge (e.g., rather than a sharp corner) on the downhole end to reduce the likelihood that equipment traveling uphole catches on or otherwise inadvertently engages with the deflector 520.

In various embodiments, the deflector 520 may be biased to either the first state, shown in FIG. 5A, or the second state, shown in FIG. 5B, and the applied control signal is applied to transition the deflector 520 to the non-biased state and removed to allow the deflector 520 to return to the biased state. In some embodiments, the deflector 520 remains in one of the first state or the second state when transitioned thereto by a control signal until a second control signal is applied to transition the deflector 520 to the other state.

Figure 6A:
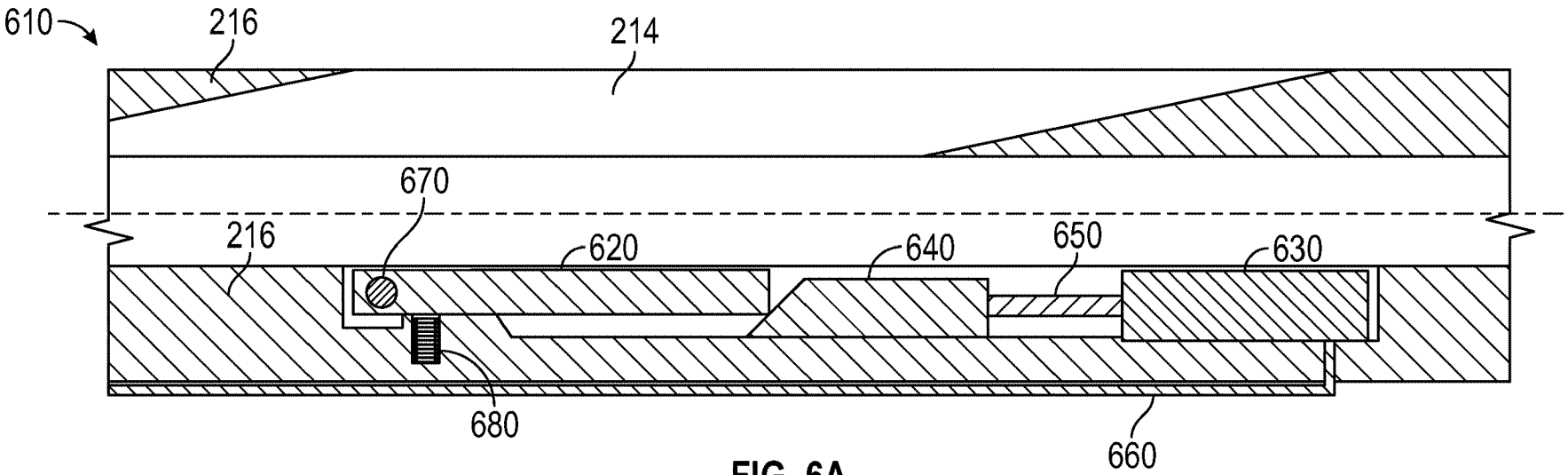
FIGS. 6A-6B are cross-sectional diagrams showing a lateral access system that includes a return spring in a first state and a second state, respectively, according to embodiments of the present disclosure.
Figure 6B:
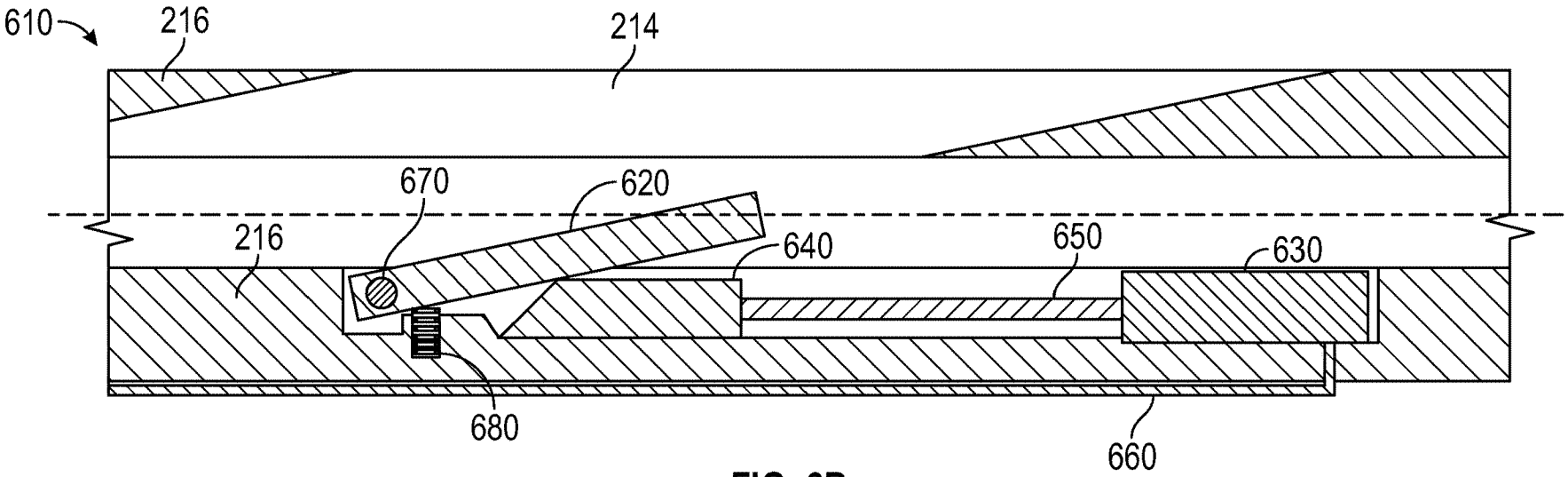

FIGS. 6A-6B are cross-sectional diagrams showing a lateral access system that includes a return spring for a deflector in a first state and a second state, respectively, according to embodiments of the present disclosure. The walls 216 of the window joint 210 incorporate a lateral access system 610, which is selectively controllable from a controller located at the surface. The lateral access system 610 may include one or more computing devices (such as the computing device 900 described in greater detail in relation to FIG. 9) to process electrical signals received from the controller. In some embodiments, in addition to or alternatively to processing electrical signals, the lateral access system 610 can use applied pressures from hydraulic or pneumatic fluids as control signals.

When in the first state, as is shown in FIG. 6A, the deflector 620 permits access between the first end and the second end of the window joint along the main pathway; whereas in the second state, as is shown in FIG. 6B, the deflector 620 blocks access between the first end and the second end of the window joint, and permits access between the first end of the window joint and the lateral opening 214, to thereby direct any equipment traveling downhole (e.g., from left to right in the illustrated view) in the main pathway to enter the lateral pathway. Similarly, in the second state, the deflector 620 helps guide any equipment traveling uphole in the lateral pathway to reenter the main pathway.

As shown in FIGS. 6A and 6B, one embodiment of the lateral access system 610 includes a deflector 620 that is rotatably mounted to the window joint via a pivot pin 670, which is transitioned between the first state and the second state via the positioning of a ramp 640 that pushes (e.g., via a wedge shape) the deflector 620 upward, into the main pathway. When the piston 650 retracts the ramp 640, a return spring 680 that is extended in the second state relaxes to pull the deflector 620 back to the first state and move out of the main pathway. In various embodiments, the ramp 640 is moved between a first position (that allows the return spring 680 to relax) and a second position (that pushes the deflector 320 upward) via a piston 650 controlled via a solenoid 630. The solenoid 630 may receive various control signals via a control line 660 connected to the above-bore controller, which communicates whether to extend, retract, or maintain a position of the piston 650 via an electrical signal or an applied pressure via a hydraulic fluid or pneumatic fluid carried in the control line 660 to extend or retract the ramp 640.

Although the deflector 620 is illustrated as having a substantially rectangular cross-section, the present disclosure contemplates that various other cross-sectional areas may be used with a deflector 620. In some embodiments, the deflector 620 may include a tapered or beveled edge (e.g., rather than a sharp corner) on the downhole end to reduce the likelihood that equipment traveling uphole catches on or otherwise inadvertently engages with the deflector 620.

Figure 7B:
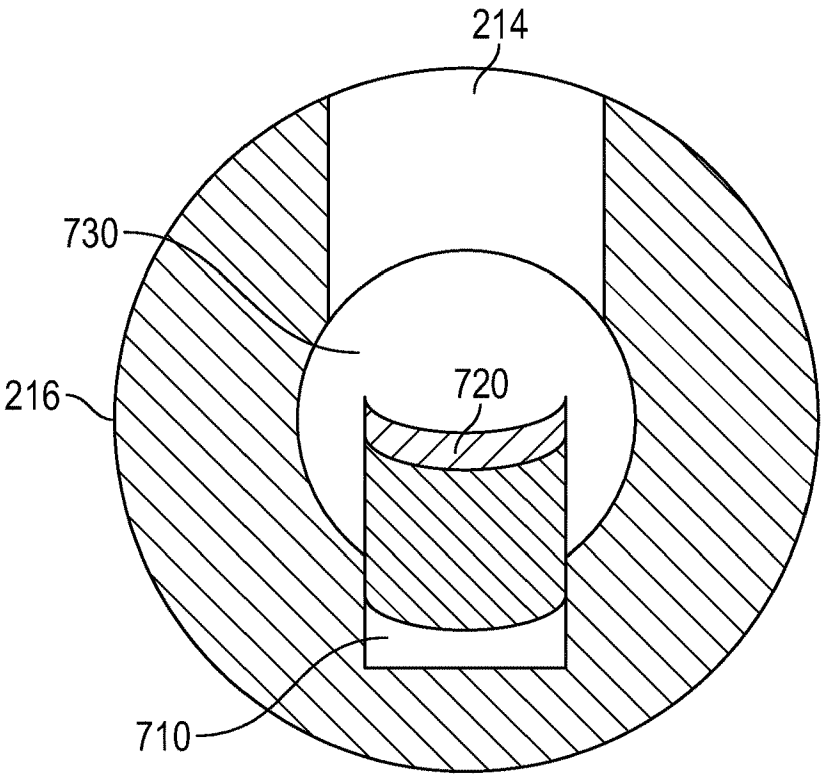
FIGS. 7A-7B are cross-sectional diagrams showing a deflector in a first state and a second state, respectively, according to embodiments of the present disclosure.
Figure 7A:
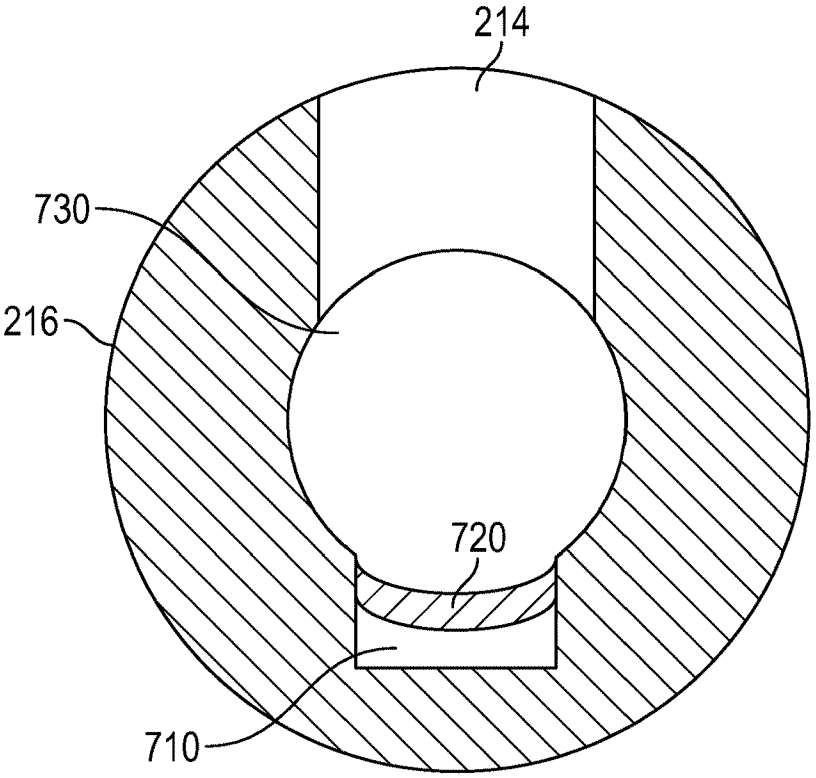

FIGS. 7A-7B are cross-sectional diagrams showing a deflector 720 in a first state and a second state, respectively, according to embodiments of the present disclosure. In various embodiments, the deflector 720 shown in FIGS. 7A-7B may correspond to any of the deflectors shown in FIG. 3A-3B, 4A-4B, 5A-5B, or 6A-6B in a different perspective than illustrated in the respective FIG. 3A-3B, 4A-4B, 5A-5B, or 6A-6B.

In the first state, shown in FIG. 7A, the deflector 720 rests at or below the inner circumference 730 of the body 216 of the window joint, in a cavity 710 defined in the body 216 with the other components of the lateral access system (not illustrated). Accordingly, when in the first state, the deflector 720 is out of the way of any equipment moving downhole or uphole through the main pathway, and thereby permits travel through the main pathway.

In the second state, shown in FIG. 7B, the deflector 720 has been elevated above the inner circumference 730 of the body 216 of the window joint, and projects out of the cavity 710 towards the lateral opening 214. In various embodiments, depending on the length of the deflector 720 and angle at which the deflector 720 projects towards the lateral opening 214, the deflector 720 may contact the opposing side of the body 216 from where the deflector 720 is connected in the cavity 710, or may leave a gap between the downhole edge of the deflector 720 and the opposing side of the body 216 that the inserted equipment can traverse when traveling into the lateral pathway. Accordingly, when in the second state, the deflector 720 blocks equipment moving downhole or uphole through the main pathway, and instead directs such equipment to travel through the lateral pathway accessible via the lateral opening 214.

Although the deflector 720 is illustrated in FIGS. 7A and 7B as having a curvature matching the curvature of the inner circumference 730, the present disclosure contemplates that the deflector 720 may have other cross-sectional shapes that include more-pronounced curvatures, less-pronounced curvatures, straight edges (e.g., no curvature), or reverse-biased curvatures (e.g., curving in an opposite direction relative to the curvature of the inner circumference 730), to help guide equipment from the main pathway into the lateral pathway (and vice versa) when in the second state.

Figure 8:
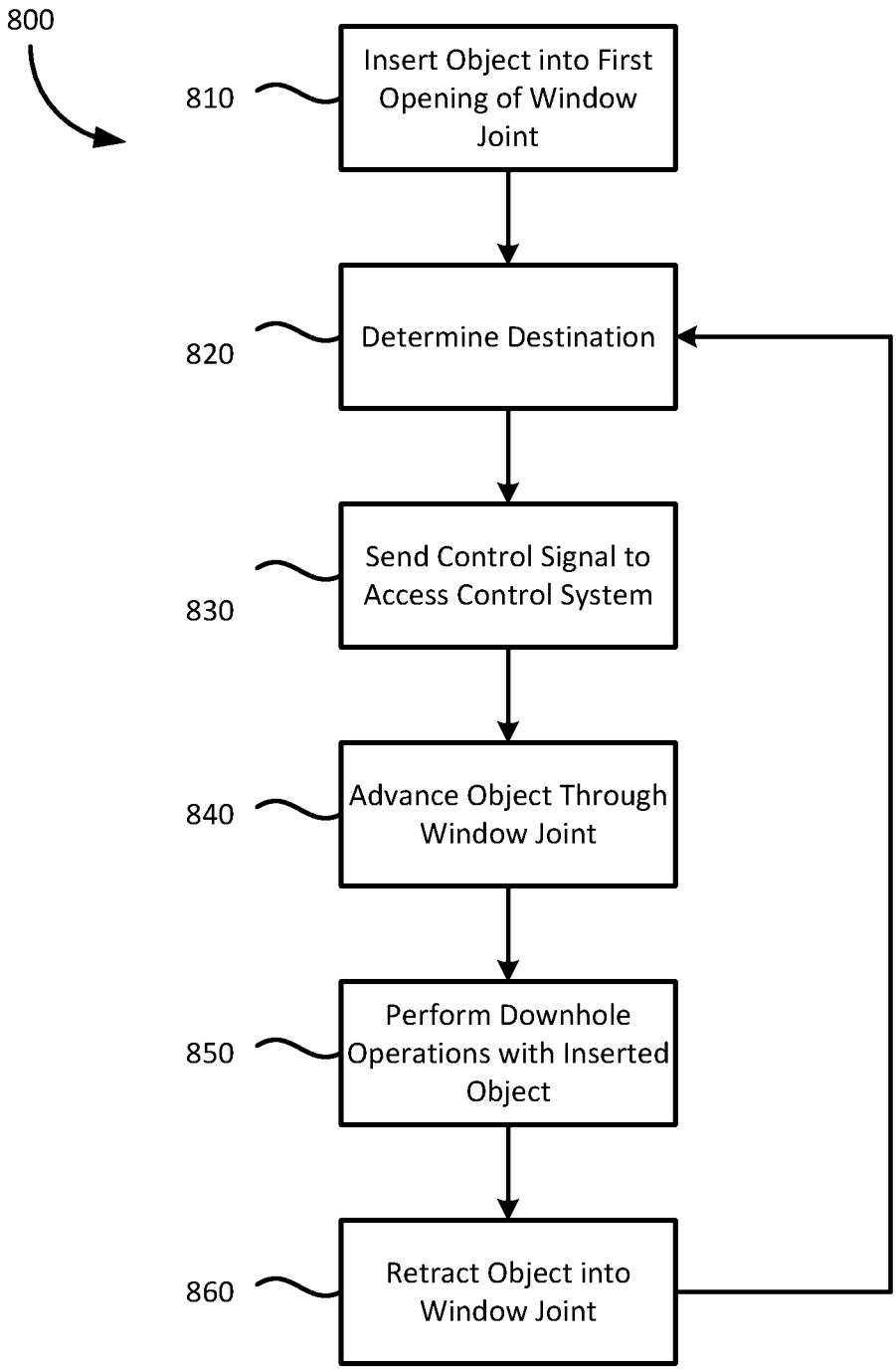
FIG. 8 is a flowchart of an example method for providing lateral access control in downhole window joints, according to embodiments of the present disclosure.

FIG. 8 is a flowchart of an example method 800 for providing lateral access control in downhole window joint, according to embodiments of the present disclosure. Method 800 begins at block 810, where an operator inserts an object into first opening of a window joint inserted into a wellbore from a surface towards an opposing end of the window joint. In various embodiments, the wellbore includes a main pathway and at least one lateral pathway that extends in a different direction from the main pathway.

At block 820, the operator determines a destination to direct the equipment to within the wellbore. In a branching bore, with one or more lateral pathways that branch from the main pathway, the operator may determine at each junction whether to continue proceeding downhole in the main pathway, or to proceed downhole to a destination in the lateral pathway. Accordingly, the operator determines whether to proceed towards the opposing end of the window joint along the main pathway or change direction and to proceed through a lateral opening in a wall of the window joint along a lateral pathway accessible from the junction.

At block 830, the operator sends, from a controller located outside of the bore to an access control system located in the window joint, a control signal to affect which pathway the equipment is directed to when proceeding. The access control system may include various actuators and electronic components controlled by a computing device to move a deflector that is integrated or integral in the window joint between various states. Depending on the biased state or current state of the deflector in the window joint at the relevant junction, the operator may send a control signal to transition the deflector from a current state to a new state, maintain an ongoing control signal that biases the deflector to the desired state, or remove (e.g., cease transmission) of an ongoing control signal to allow the deflector to return from a current state to a desired state.

In some embodiments, when the destination is downhole along the lateral pathway through a lateral opening, transitioning the deflector to the desired state includes blocking a pathway through the main pathway (e.g., from the first opening towards the opposite end) at a junction with the lateral pathway to guide the object through the lateral opening.

In some embodiments, when the destination is downhole along the main pathway, transitioning the deflector to the desired state includes opening a pathway through the main pathway (e.g., from the first opening towards the opposite end) at a junction with a lateral pathway to guide the equipment away from the lateral opening and downhole along the main pathway.

At block 840, the operator continues to advance the instrument through the bore, either being permitted to continue down the main pathway or being directed into the lateral pathway according to the state of the deflector set per block 830. The object therefore advances to the selected destination in a single insertion operation; without having to insert a separate deflector into the window joint via a distinct insertion operation (and then to be removed via s distinct removal operation) using multiple insertion operations.

At block 850, the after the equipment reaches the initial destination, the operator performs various downhole operations using the object. In various embodiments, the object may include various a downhole tools that the operator controls from the surface to perform various different operations at the destination.

At block 850, after the object has performed the downhole operations at the initial destination, the operator retracts the equipment from the initial destination, back into the window joint. In various embodiments, the operator may withdraw the window joint (as part of a removable liner or a downhole tool being retrieved) from the bore, and method 800 may then conclude. In some embodiments, when the window joint is part of a downhole tool, the operator may progress the window joint to a subsequent destination in the bore, and method 800 may return to block 820 to determine how to proceed to the next destination (e.g., sending a subsequent control signal to transition the deflector disposed within the window joint to different state than initially selected and directing the equipment to a different destination that initially selected).

Figure 9:
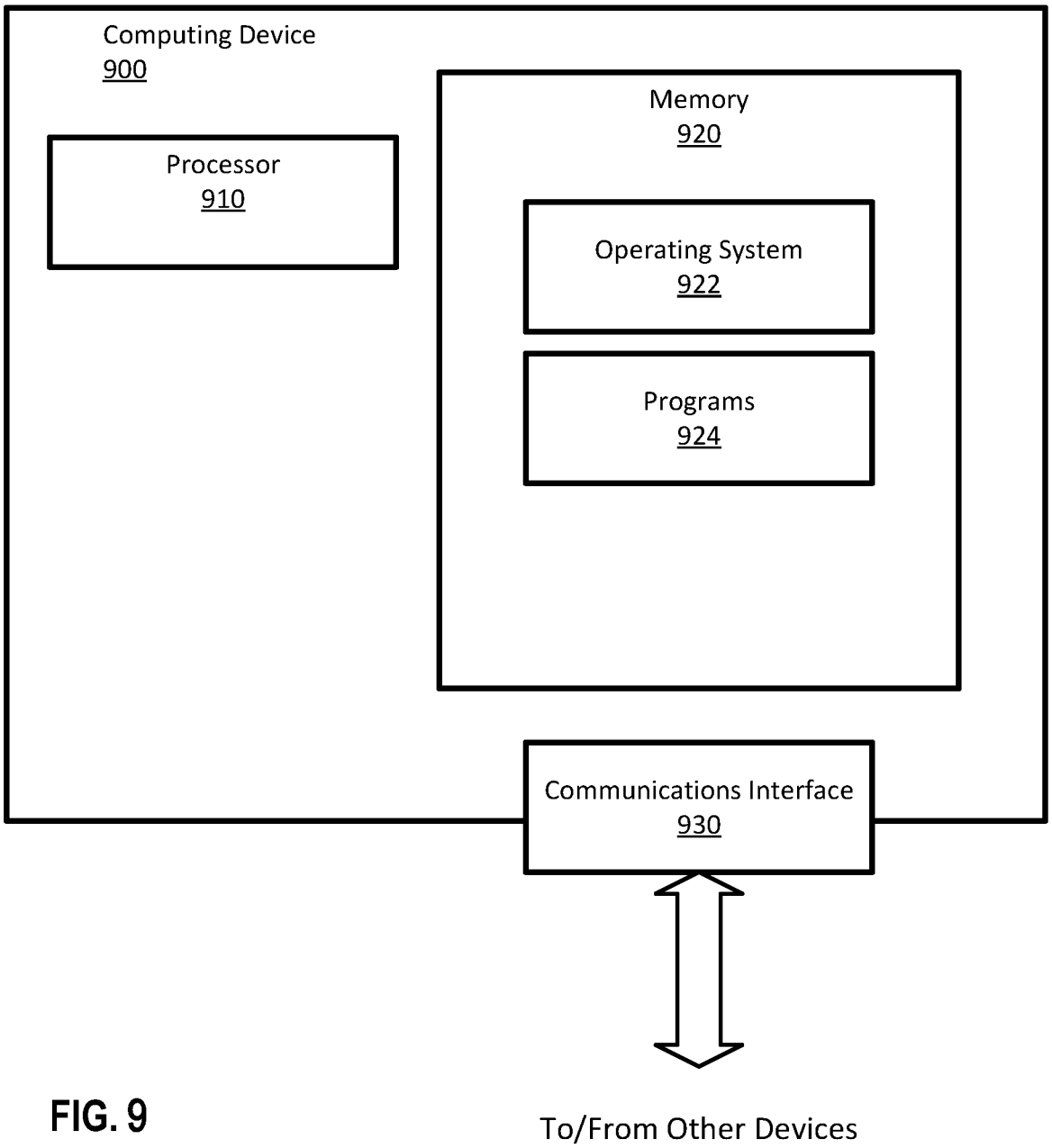
FIG. 9 is a block diagram of an example computing device, as may be used to perform operations of a method for providing lateral access control in downhole window joints, according to embodiments of the present disclosure.

FIG. 9 is a block diagram of an example computing device 900, as may be used to perform operations of a method for providing lateral access control in downhole window joints, according to embodiments of the present disclosure. The computing device 900 may include at least one processor 910, a memory 920, and a communication interface 930. In various embodiments, the physical components may offer virtualized versions thereof, such as when the computing device 900 is part of a cloud infrastructure providing virtual machines (VMs) to perform some or all of the tasks or operations described for the various devices in the present disclosure.

The processor 910 may be any processing unit capable of performing the operations and procedures described in the present disclosure. In various embodiments, the processor 910 can represent a single processor, multiple processors, a processor with multiple cores, and combinations thereof. Additionally, the processor 910 may include various virtual processors used in a virtualization or cloud environment to handle client tasks.

The memory 920 is an apparatus that may be either volatile or non-volatile memory and may include RAM, flash, cache, disk drives, and other computer readable memory storage devices. Although shown as a single entity, the memory 920 may be divided into different memory storage elements such as RAM and one or more hard disk drives. Additionally, the memory 920 may include various virtual memories used in a virtualization or cloud environment to handle client tasks. As used herein, the memory 920 is an example of a device that includes computer-readable storage media, and is not to be interpreted as transmission media or signals per se.

As shown, the memory 920 includes various instructions that are executable by the processor 910 to provide an operating system 922 to manage various operations of the computing device 900 and one or more programs 924 to provide various features to users of the computing device 900, which include one or more of the features and operations described in the present disclosure. One of ordinary skill in the relevant art will recognize that different approaches can be taken in selecting or designing a program 924 to perform the operations described herein, including choice of programming language, the operating system 922 used by the computing device, and the architecture of the processor 910 and memory 920. Accordingly, the person of ordinary skill in the relevant art will be able to select or design an appropriate program 924 based on the details provided in the present disclosure.

The communication interface 930 facilitates communications between the computing device 900 and other devices, which may also be computing devices 900 as described in relation to FIG. 9. In various embodiments, the communication interface 930 includes antennas for wireless communications and various wired communication ports. The computing device 900 may also include or be in communication, via the communication interface 930, one or more input devices (e.g., a keyboard, mouse, pen, touch input device, etc.) and one or more output devices (e.g., a display, speakers, a printer, etc.).

Accordingly, the computing device 900 is an example of a system that includes a processor 910 and a memory 920 that includes instructions that (when executed by the processor 910) perform various embodiments of the present disclosure. Similarly, the memory 920 is an apparatus that includes instructions that when executed by a processor 910 perform various embodiments of the present disclosure.

Programming modules, may include routines, programs, components, data structures, and other types of structures that may perform particular tasks or that may implement particular abstract data types. Moreover, embodiments may be practiced with other computer system configurations, including hand-held devices, multiprocessor systems, microprocessor-based or programmable user electronics, minicomputers, mainframe computers, and the like. Embodiments may also be practiced in distributed computing environments where tasks are performed by remote processing devices that are linked through a communications network. In a distributed computing environment, programming modules may be located in both local and remote memory storage devices.

Furthermore, embodiments may be practiced in an electrical circuit comprising discrete electronic elements, packaged or integrated electronic chips containing logic gates, a circuit using a microprocessor, or on a single chip containing electronic elements or microprocessors (e.g., a system-on-a-chip (SoC)). Embodiments may also be practiced using other technologies capable of performing logical operations such as, for example, AND, OR, and NOT, including, but not limited to, mechanical, optical, fluidic, and quantum technologies. In addition, embodiments may be practiced within a general purpose computer or in any other circuits or systems.

Embodiments may be implemented as a computer process (method), a computing system, or as an article of manufacture, such as a computer program product or computer-readable storage medium. The computer program product may be a computer-readable storage medium readable by a computer system and encoding a computer program of instructions for executing a computer process. Accordingly, hardware or software (including firmware, resident software, micro-code, etc.) may provide embodiments discussed herein. Embodiments may take the form of a computer program product on a computer-usable or computer-readable storage medium having computer-usable or computer-readable program code embodied in the medium for use by, or in connection with, an instruction execution system.

Although embodiments have been described as being associated with data stored in memory and other storage mediums, data can also be stored on or read from other types of computer-readable media, such as secondary storage devices, like hard disks, floppy disks, or a CD-ROM, or other forms of RAM or ROM. The term computer-readable storage medium refers only to devices and articles of manufacture that store data or computer-executable instructions readable by a computing device. The term computer-readable storage medium does not include computer-readable transmission media.

Embodiments described in the present disclosure may be used in various distributed computing environments where tasks are performed by remote processing devices that are linked through a communications network.

Embodiments described in the present disclosure may be implemented via local and remote computing and data storage systems. Such memory storage and processing units may be implemented in a computing device. Any suitable combination of hardware, software, or firmware may be used to implement the memory storage and processing unit. For example, the memory storage and processing unit may be implemented with computing device 900 or any other computing devices 900, in combination with computing device 900, wherein functionality may be brought together over a network in a distributed computing environment, for example, an intranet or the Internet, to perform the functions as described herein. The systems, devices, and processors described herein are provided as examples; however, other systems, devices, and processors may comprise the aforementioned memory storage and processing unit, consistent with the described embodiments.

In addition to the embodiments discussed above, many examples of specific combinations are within the contemplate scope of the present disclosure, some of which may be understood with reference to the following numbered clauses.

Clause 1: A system locatable in a wellbore for use with an object, comprising: a window joint comprising: an interior cavity with a first end and a second end opposite to the first end; a first opening defined at the first end; and a lateral opening through a wall of the window joint and into the interior cavity between the first end and the second end; a deflector integral to the window joint wherein: in a first state, the deflector is configured to permit access between the first end and the second end; and in a second state, the deflector is configured to block access between the first end and the second end, and permits access between the first end and the lateral opening by deflecting the object travelling through the lateral opening; and an access control system disposed within the window joint, configured to transition the deflector between the first state and the second state.

Clause 2: The system of any of clauses 1 or 3-13, further comprising a controller located outside of the wellbore in which the window joint is inserted and in communication with the access control system, the controller comprising a processor and a memory storing instructions executable by the processor to signal the access control system to transition the deflector between the first state and the second state.

Clause 3: The system any of clauses 1-2 or 4-13, wherein the deflector transitions between the first state and the second state by pivoting about a pivot pin.

Clause 4: The system of any of clauses 1-3 or 4-13, wherein the deflector comprises a spring that is relaxed when the deflector is in the first state.

Clause 5: The system of any of clauses 1-4 or 6-13, wherein the access control system comprises a piston operable to drive a ramp between a first position, to place the deflector in the first state, and a second position, to place the deflector in the second state, wherein the piston is extended and retracted via at least one of a hydraulic fluid, a pneumatic fluid, a solenoid, or an electrical motor.

Clause 6: The system of any of clauses 1-5 or 7-13, wherein the access control system comprises a bar linkage connected to the deflector, wherein the bar linkage is driven between a first extension, to place the deflector in the first state, and a second extension, to place the deflector in the second state.

Clause 7: The system of any of clauses 1-6 or 8-13, wherein the access control system comprises an electromagnetic track and a ramp that, when the electromagnetic track is energized, is driven between a first station on the electromagnetic track, to place the deflector in the first state, and a second station on the electromagnetic track, to place the deflector in the second state.

Clause 8: The system of any of clauses 1-7 or 9-13, further comprising a return spring connected between the deflector and a cavity defined in the interior cavity in which the deflector is retracted when in the first state, wherein the return spring is placed under tension when the deflector is in the second state.

Clause 9: The system of any of clauses 1-8 or 10-13, wherein the access control system is positioned downhole in the window joint relative to the deflector.

Clause 10: The system of any of clauses 1-9 or 11-13, wherein: the deflector is disposed in a first side of the window joint and the lateral opening is formed in a second side of the window joint, opposite to the first side; and in the second state, the deflector contacts the second side.

Clause 11: The system of any of clauses 1-10 or 12-13, wherein the window joint includes at least one of a second deflector or a second access control system that are of a different design than the deflector or the access control system, respectively.

Clause 12: The system of any of clauses 1-12 or 13, wherein the window joint is incorporated in a liner for the borchole.

Clause 13: The system of any of clauses 1-12, wherein the window joint is incorporated into a downhole tool configured for insertion into the borehole.

Clause 14: A system locatable in a wellbore and for use with an object, comprising: an access control system disposed within a window joint inserted into a wellbore having a main pathway and a lateral pathway; a deflector integral to the window joint a junction of the wellbore between the main pathway and the lateral pathway and that operates in a first state and a second state; and a controller, including a processor and a memory including instructions executable by the processor, located outside of the wellbore and in communication with the access control system located in the wellbore; wherein: in response to a first command from the controller, the access control system transitions the deflector to the first state; in response to a second command from the controller, the access control system transitions the deflector to the second state; in the first state the deflector permits access at the junction between a first opening of the bore and a downhole end of the bore; and in the second state the deflector blocks access at the junction between the first opening of the wellbore and the downhole end of the bore so that the deflector, when in the second state, is configured to guide the object at the junction into the lateral pathway.

Clause 15: The system of any of clauses 14 or 16-19, wherein the access control system includes at least one of: a piston that drives a ramp between a first position, to place the deflector in the first state, and a second position, to place the deflector in the second state; a bar linkage to a free end of the deflector, opposite to a connected end of the deflector, wherein the bar linkage is driven between a first extension, to place the deflector in the first state, and a second extension, to place the deflector in the second state; or an electromagnetic track and the ramp that, when the electromagnetic track is energized, is driven between a first station on the electromagnetic track, to place the deflector in the first state, and a second station on the electromagnetic track, to place the deflector in the second state.

Clause 16: The system of any of clauses 14-15 or 17-19, further comprising a spring configured to be under tension when the deflector is in the second state and to release tension to return the deflector to the first state from the second state.

Clause 17: The system of any of clauses 14-16 or 18-19, wherein the window joint includes at least one of a second deflector or a second access control system that are of a different design than the deflector or the access control system, respectively.

Clause 18: The system of any of clauses 14-17 or 19, wherein the window joint is incorporated in a liner for the borehole.

Clause 19: The system of any of clauses 14-18, wherein the window joint is incorporated into a downhole tool configured for insertion into the borehole.

Clause 20: A method, comprising: inserting an object into a first opening of a window joint inserted into a wellbore from a surface towards an opposing end of the window joint, wherein the wellbore includes main pathway and a lateral pathway extending from the main pathway; making a determination for a destination to direct the object to from a junction in the wellbore between the main pathway and the lateral pathway, the destination being downhole from the junction to one of the main pathway or the lateral pathway; sending, from a controller located outside of the wellbore to an access control system located in the window joint, a control signal to transition a deflector integral to the window joint from a first state to a second state based on the determination; and directing the object to the destination based on the deflector being in the first state or the second state.

Clause 21: The method of any of clauses 20 and 22-29, wherein the destination is downhole through a lateral opening in the window joint, and transitioning the deflector from the first state to the second state includes blocking the main pathway at the junction and guiding the object through the lateral opening.

Clause 22: The method of any of clauses 20-21 and 23-29, wherein the destination is downhole along the main pathway, and transitioning the deflector from the first state to the second state includes opening access at the junction to the main pathway that is blocked by the deflector when in the first state.

Clause 23: The method of any of clauses 20-22 and 24-29, further comprising: retracting the object from the destination back into the window joint uphole relative to the deflector; sending, from the controller to the access control system, a second control signal to transition the deflector to the second state from the first state; and directing the object downhole to a new destination via the deflector in the second state.

Clause 24: The method of any of clauses 20-23 and 25-29, wherein control signal is transmitted via an applied pressure of a hydraulic fluid or a pneumatic fluid.

Clause 25: The method of any of clauses 20-24 and 26-29, wherein the deflector is biased to return to the first state when the control signal is removed, the method further comprising: removing the control signal from the deflector.

Clause 26: The method of any of clauses 20-25 and 27-29, wherein the object is a downhole tool and the downhole tool is directed to the destination to perform a downhole operation.

Clause 27: The method of any of clauses 20-26 or 28-29, wherein the window joint includes at least one of a second deflector or a second access control system that are of a different design than the deflector or the access control system, respectively.

Clause 28: The method of any of clauses 20-27 or 29, wherein the window joint is incorporated in a liner for the borehole.

Clause 29: The method of any of clauses 20-28, wherein the window joint is incorporated into a downhole tool configured for insertion into the borehole.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

As used in the present disclosure, a phrase referring to "at least one of" a list of items refers to any set of those items, including sets with a single member, and every potential combination thereof. For example, when referencing "at least one of A, B, or C" or "at least one of A, B, or C", the phrase is intended to cover the sets of: A, B, C, A-B, B-C, and A-B-C, where the sets may include one or multiple instances of a given member (e.g., A-A, A-A-A, A-A-B, A-A-B-B-C-C-C, etc.) and any ordering thereof.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system locatable in a wellbore for use with an object, comprising:

a window joint comprising: an interior cavity with a first end and a second end opposite to the first end;

a first opening defined at the first end; and a lateral opening through a wall of the window joint and into the interior cavity between the first end and the second end;

a deflector integral to the window joint wherein:

in a first state, the deflector is configured to permit access between the first end and the second end; and in a second state, the deflector is configured to block access between the first end and the second end, and permit access between the first end and the lateral opening by deflecting the object travelling through the lateral opening, wherein the deflector comprises a bendable spring that is relaxed when the deflector is in the first state, the bendable spring comprising a bow spring or a cantilever spring; and an access control system disposed within the window joint, configured to transition the deflector between the first state and the second state.

2. The system of claim 1, further comprising a controller located outside of the wellbore and in communication with the access control system, the controller comprising a processor and a memory storing instructions executable by the processor to signal the access control system to transition the deflector between the first state and the second state.

3. The system of claim 1, wherein the access control system comprises a piston operable to drive a ramp between a first position, to place the deflector in the first state, and a second position, to place the deflector in the second state, wherein the piston is extended and retracted via at least one of a hydraulic fluid, a pneumatic fluid, a solenoid, or an electrical motor.

4. The system of claim 1, wherein the access control system comprises an electromagnetic track and a ramp that, when the electromagnetic track is energized, is driven between a first station on the electromagnetic track, to place the deflector in the first state, and a second station on the electromagnetic track, to place the deflector in the second state.

5. The system of claim 1, wherein the access control system is positioned downhole in the window joint.

6. The system of claim 1, wherein:

the deflector is disposed in a first side of the window joint and the lateral opening is formed in a second side of the window joint, opposite to the first side; and in the second state, the deflector contacts the second side.

7. The system of claim 1, wherein in the second state there is a gap between a downhole edge of the deflector and an opposing side of the window joint from where the deflector is connected.

8. A system locatable in a wellbore and for use with an object, comprising:

an access control system disposed within a window joint inserted into the wellbore having a main pathway and a lateral pathway;

a deflector integral to the window joint at a junction of the wellbore between the main pathway and the lateral pathway and that operates in a first state and a second state, wherein the deflector comprises a bendable spring that is relaxed when the deflector is in the first state, the bendable spring comprising a bow spring or a cantilever spring; and a controller, including a processor and a memory including instructions executable by the processor, located outside of the wellbore and in communication with the access control system located in the wellbore;

wherein:

in response to a first command from the controller, the access control system transitions the deflector to the first state;

in response to a second command from the controller, the access control system transitions the deflector to the second state;

in the first state the deflector permits access at the junction between a first opening of the bore and a downhole end of the bore; and in the second state the deflector blocks access at the junction between the first opening of the wellbore and guides the object at the junction into the lateral pathway.

9. The system of claim 8, wherein the access control system includes at least one of:

a piston that drives a ramp between a first position, to place the deflector in the first state, and a second position, to place the deflector in the second state; or an electromagnetic track and the ramp that, when the electromagnetic track is energized, is driven between a first station on the electromagnetic track, to place the deflector in the first state, and a second station on the electromagnetic track, to place the deflector in the second state.

10. The system of claim 8, wherein in the second state there is a gap between a downhole edge of the deflector and an opposing side of the window joint from where the deflector is connected.

11. A method, comprising:

inserting an object into a first opening of a window joint inserted into a wellbore from a surface towards an opposing end of the window joint, wherein the wellbore includes a main pathway and a lateral pathway extending from the main pathway;

making a determination for a destination to direct the object to from a junction in the wellbore between the main pathway and the lateral pathway, the destination being downhole from the junction to one of the main pathway or the lateral pathway;

sending, from a controller located outside of the wellbore to an access control system located in the window joint, a control signal to transition a deflector from a first state to a second state based on the determination, the deflector integral to the window joint and comprising a bendable spring that is relaxed in the first state, the bendable spring comprising a bow spring or a cantilever spring; and directing the object to the destination based on the deflector being in the first state or the second state.

12. The method of claim 11, wherein the destination is downhole through a lateral opening in the window joint, and transitioning the deflector from the first state to the second state includes blocking the main pathway at the junction and guiding the object through the lateral opening.

13. The method of claim 11, wherein the destination is downhole along the main pathway, and transitioning the deflector from the first state to the second state includes opening access at the junction to the main pathway that is blocked by the deflector when in the first state.

14. The method of claim 11, further comprising:

retracting the object from the destination back into the window joint uphole relative to the deflector;

sending, from the controller to the access control system, a second control signal to transition the deflector to the second state from the first state; and directing the object downhole to a new destination via the deflector in the second state.

15. The method of claim 11, wherein control signal is transmitted via an applied pressure of a hydraulic fluid or a pneumatic fluid.

16. The method of claim 11, wherein the deflector is biased to return to the first state when the control signal is removed, the method further comprising removing the control signal from the deflector.

17. The method of claim 11, wherein the object is a downhole tool and the downhole tool is directed to the destination to perform a downhole operation.

18. The method of claim 12, wherein in the second state there is a gap between a downhole edge of the deflector and an opposing side of the window joint from where the deflector is connected.

* * * * *